US009377265B2

(12) United States Patent
Marvin

(10) Patent No.: US 9,377,265 B2
(45) Date of Patent: Jun. 28, 2016

(54) GUN BARREL CLEANING DEVICE

(71) Applicant: Claire C. Marvin, New Albany, OH (US)

(72) Inventor: Claire C. Marvin, New Albany, OH (US)

( * ) Notice: Subject to any disclaimer, the term of this patent is extended or adjusted under 35 U.S.C. 154(b) by 0 days.

(21) Appl. No.: 14/224,126

(22) Filed: Mar. 25, 2014

(65) Prior Publication Data

US 2015/0153129 A1 Jun. 4, 2015

Related U.S. Application Data

(60) Provisional application No. 61/911,779, filed on Dec. 4, 2013.

(51) Int. Cl.
*F41A 29/02* (2006.01)
*B08B 9/02* (2006.01)

(52) U.S. Cl.
CPC .. *F41A 29/02* (2013.01); *B08B 9/02* (2013.01)

(58) Field of Classification Search
CPC ..... F41A 29/02; B08B 9/00; B08B 9/02
USPC ..... 42/95; 15/176.1, 176.6, 104.16, 15/104.165, 104.2
See application file for complete search history.

(56) References Cited

U.S. PATENT DOCUMENTS

| | | | | |
|---|---|---|---|---|
| 1,493,848 | A * | 5/1924 | Ebert | 15/176.6 |
| 2,379,962 | A | 7/1945 | Hoerle | |
| 5,746,279 | A | 5/1998 | Havlinek et al. | |
| 5,934,000 | A | 8/1999 | Hayes, Sr. | |
| 8,448,370 | B2 | 5/2013 | Williams | |
| 2007/0051027 | A1 | 3/2007 | Stordal | |
| 2007/0261288 | A1 | 11/2007 | Perry et al. | |
| 2011/0209379 | A1 | 9/2011 | Williams | |
| 2013/0091753 | A1 | 4/2013 | Rogers et al. | |

* cited by examiner

*Primary Examiner* — Laura C Guidotti
(74) *Attorney, Agent, or Firm* — Standley Law Group LLP

(57) ABSTRACT

The present invention is an improvement to a gun barrel cleaning device which enables a user to attach and remove gun barrel cleaning attachments to a gun barrel cleaning rod by inserting the cleaning attachment into a recess formed in the cleaning rod and twisting for a partial full turn the cleaning attachment in relationship to the gun barrel cleaning rod.

16 Claims, 3 Drawing Sheets

GUN BARREL CLEANING DEVICE

CROSS-REFERENCE TO RELATED APPLICATION

This application claims priority to provisional application 61/911,779, filed on Dec. 4, 2013 and is herein incorporated by reference in its entirety.

TECHNICAL FIELD

Exemplary embodiments of the present invention relate generally to a device for cleaning debris from a gun barrel and a method of use for such a device.

BACKGROUND AND SUMMARY OF THE INVENTION

Firearms generally comprise a barrel structure, a chamber for housing a propellant, and a method of causing the propellant to propel a projectile down the barrel structure. The barrel structure is intended to guide the projectile toward its intended target. Frequently the inner surface of the barrel structure may be caused to have spiral indentations intended to cause the projectile to spin as it travels down the barrel. Such spin imparts stability and may result in a projectile that more consistently travels the path imparted by the barrel assembly. Other embodiments of firearms may have smooth inner barrel structure surfaces. Such other embodiments may rely on other methods of guiding a projectile towards its intended target. In order to guide a projectile towards its intended target, the inner surface of the barrel structure may have an inner diameter that is very close to the outer diameter of the projectile. This closeness in diameter is particularly critical when the barrel is designed to impart a spinning motion on the projectile.

Projectiles are frequently comprised of lead or other malleable material. In addition, some projectiles may have a coating or jacket material such as copper. As these projectiles travel down the barrel, the closeness in diameter causes the projectile to rub against the barrel assembly inner surface. The result may be traces of lead, copper, or other materials deposited from the projectile onto the barrel assembly.

Many embodiments of firearms rely on a propellant such as gunpowder or a similar chemical composition to propel a projectile down the barrel assembly. These designs may use a pressure sensitive substance to ignite the gunpowder in response to a user action such as pulling a trigger device. When the gunpowder ignites, it causes an explosion within a portion of the barrel assembly resulting in a rapidly expanding gas. This gas causes the projectile to travel rapidly down the barrel assembly and then continue on to the intended target. As the result of the exploding gunpowder, chemical particles may be deposited onto the inner surface of the barrel assembly.

As described above, traces of lead, copper, and other materials as well as chemical particles that result from the explosion of propellant may be deposited on the barrel assembly inner surface. Over time, such deposits may damage the surface of the gun barrel assembly and can interfere with the interface between the projectile and the gun barrel. Such interference may result in a reduction of the accuracy and performance of the firearm. As a result, the inner surface of the barrel assembly should be regularly cleaned to remove deposits.

Cleaning devices such as rods or cable devices are known in the art. Such devices commonly have removable cleaning attachments. During an exemplary process for cleaning a barrel assembly these attachments may be removed and replaced with attachments for performing the various steps in the cleaning process. For example, an attachment for holding a cloth saturated with a cleaning solution may be caused to be attached to a cleaning rod. This cloth may then be pushed or pulled through the barrel assembly to cause cleaning solution to be deposited therein. The attachment for holding a cloth may be removed from the cleaning rod and replaced with a brush or scraper device to remove deposits from the barrel assembly. In this exemplary cleaning process the brush or scraper may be removed and replaced with another attachment for holding a cloth that contains a corrosion inhibitor or lubricant material. As with the cleaning solution saturated cloth, this cloth may be pushed or pulled through the barrel assembly to deposit the corrosion inhibitor or lubricant onto the deposited on the barrel assembly inner surface.

As described, it is common for a cleaning process to be performed using multiple steps where each step may require a different attachment. A common problem during the performance of such steps is the recurring need to remove and replace the various attachments used during the cleaning process. Known designs of cleaning attachments, cleaning rods, and cleaning cables use a threaded interface between the rod or cable and the cleaning attachments. Such a threaded interface requires that the user twist the cleaning attachment to engage the threaded interface and continue to twist until the threaded cleaning attachment is fully secured to the rod or cable. In order to accommodate longer gun barrel assemblies, sections of rod or cable are frequently required to be threaded together in a manner similar to what was described for attaching the cleaning attachment. In addition to being time consuming and tedious to assemble, threaded assemblies may be susceptible to cross-threading which may damage or destroy the threaded connection. Such a damaged connection may separate during use, resulting in a cleaning attachment becoming lodged in the barrel assembly or barrel damage from the unsecured cleaning rod or cable. A known improvement to such a threaded connection is a connection that uses an enlarged end located on the cleaning attachment which is inserted into a keyhole shaped receiver located on a cleaning rod or cable. While such a connection eliminates the need to thread a cleaning attachment onto a barrel cleaning rod or cable, it only serves to secure the connection during a pulling motion. A pushing motion may cause this connection to release or become misaligned. The ability to push and pull a cleaning attachment through a gun barrel assembly allows for a more effective cleaning operation and eliminates the need to pull a cleaning attachment through the gun barrel assembly, disconnect the attachment from the cleaning rod or cable, reinsert the cleaning rod or cable, and reattach the cleaning attachment in order to perform the cleaning step a second time. With an attachment method that allows a user to apply a pushing and pulling motion to a cleaning attachment, that user may "scrub" the cleaning attachment back and forth in areas of the gun barrel assembly that require additional cleaning.

What is needed is a device to allow a user to quickly and easily change from one attachment to another during the cleaning process where such a device allows the user to both push and pull a cleaning attachment through a gun barrel assembly without unintended disconnection of the cleaning attachment from the cleaning rod or cable.

In an exemplary embodiment of the present invention, a bayonet connector type interface between a cleaning rod or cable and cleaning attachment or additional segments of cleaning rod or cable may be formed using at least one engagement tab which protrudes radially from a first section of the interface. A second section of the interface comprises at least one first section of channel to receive the at least one engagement tab. The second section of the interface may also comprise at least one second section of channel which is connected to but diverging at about a right angle from a first section of channel. In the described exemplary embodiment, the first section of the interface is positioned such that an engagement tab of the first section enters a first section of channel of the second section of the interface. The first and second sections may be positioned such that an engagement tab of the first section moves farther into the channel of the second section. Such movement may continue until the first and second sections may not be moved closer together. In the exemplary embodiment, the first section may be rotated in a manner to cause the engagement tab to move from the first section of channel to a second section of channel. Such a rotation may be continued until the engagement tab reaches the end of second section of channel. The second section of channel may further comprise a structure that resists movement of the engagement tab away from the end of the second section. In such an embodiment, the interface may be used to enable a user to connect a cleaning rod or cable to a cleaning attachment or an additional cleaning rod or cable by pushing such rod or cable and cleaning attachment together and partially twisting.

BRIEF DESCRIPTION OF THE DRAWINGS

In addition to the novel features and advantages mentioned above, other benefits will be readily apparent from the following descriptions of the drawings and exemplary embodiments.

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

The present invention comprises an improved device for cleaning tubular barrel assemblies, including gun barrels. One skilled in the art will realize that such an invention may be used to clean other elongated tubular structures such as, but not limited to, pipes, musical instruments, chimneys, and laboratory instruments. A preferred embodiment of the present invention may utilize a molded plastic material as described herein but one ordinarily skilled in the art will understand that an equivalent device may be fabricated from other materials including, but not limited to, metals, wood, and glass without departing from the spirit of the invention.

Figure 1:
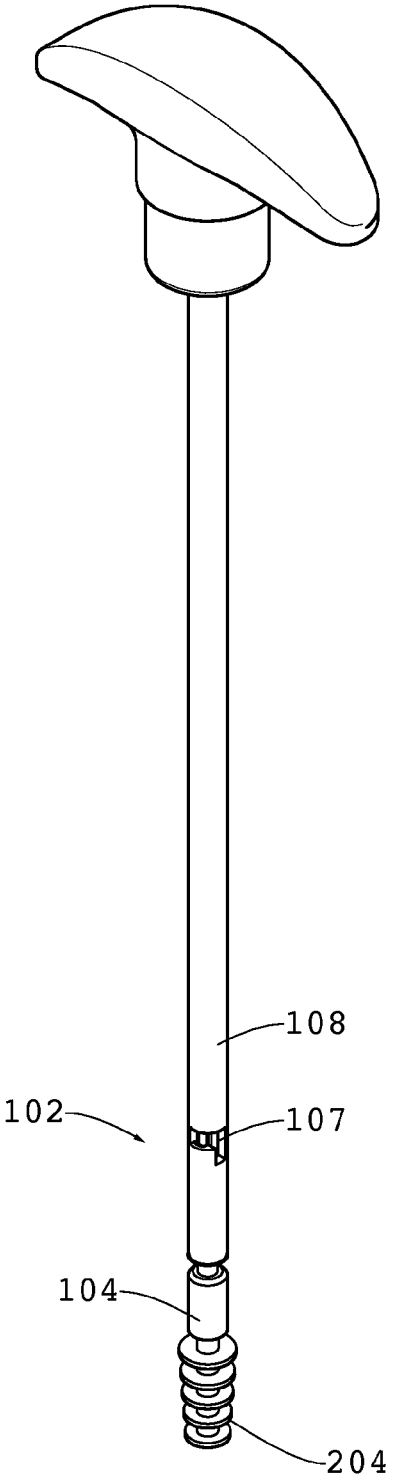
FIG. 1 is a perspective view illustration of an embodiment of the invention applied to a cleaning rod and cleaning device interface.

FIG. 1 illustrates, in a perspective view, a barrel cleaning device configured with an embodiment of the invention. As is illustrated at 102, a cleaning device interface 104 is secured in a recess formed in a cleaning rod 108.

Figure 2:
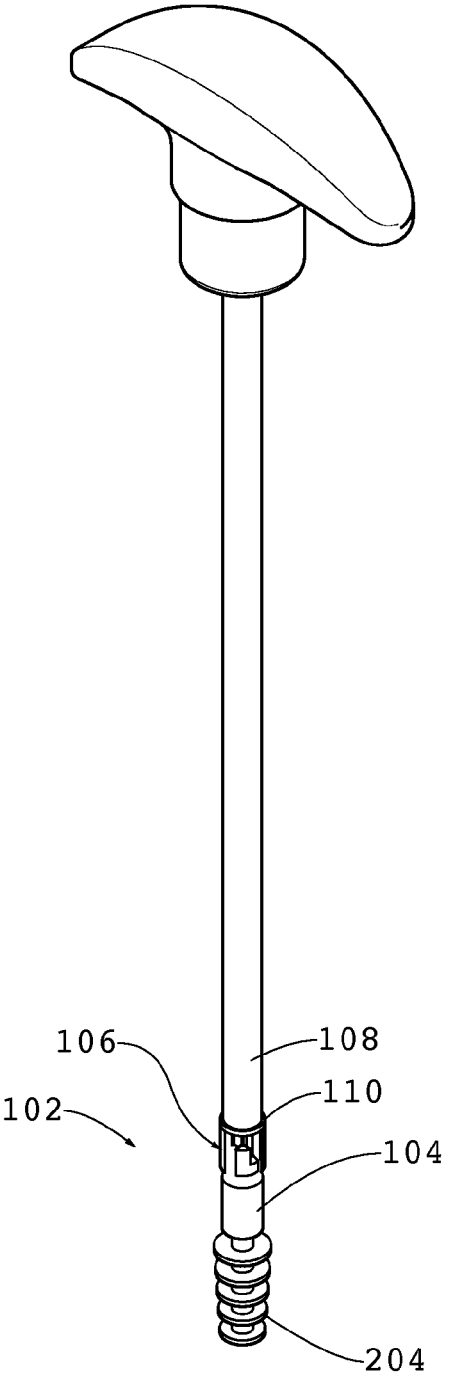
FIG. 2 is a perspective view illustration of another embodiment of the invention applied to a cleaning rod and cleaning device interface.
Figure 3:
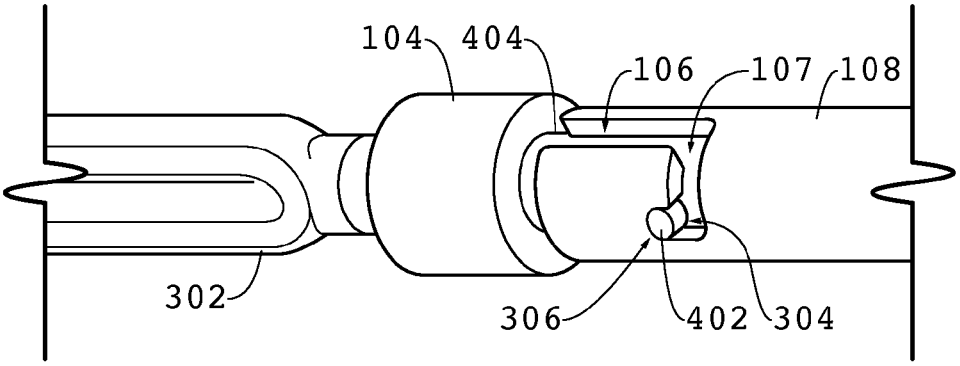
FIG. 3 is an enlarged perspective view showing a portion of an embodiment of the invention applied cleaning rod and cleaning device interface.

FIG. 2 illustrates another embodiment of the invention. In the embodiment illustrated in FIG. 2, a sleeve 110 is used to cover the recess and any openings formed therein. The sleeve 110 is illustrated as semi-transparent to illustrate the internal structure of the invention however; embodiments of the invention may alternatively utilize an opaque material for the sleeve. FIG. 2 also illustrates a barrel cleaning device 204. In the embodiment shown in FIG. 2 the cleaning device 204 is secured to or may be integrally formed into an end of a cleaning device interface 104. FIG. 3 illustrates an enlarged view of a first channel 106 and a second channel 107. As illustrated, a first channel 106 may be formed proximate to an end of, and approximately parallel to the axis of the cleaning rod. Such a channel may terminate at a second channel 107 which diverges from the first channel at about a 90 degree angle. In certain embodiments of the invention, such a second channel 107 may be more or less than 90 degrees from that of the first channel. These channels may be open to the exterior surface of the cleaning rod as is illustrated in FIG. 3, enclosed by a covering device 110, or formed such that one or both of the channels are covered by an outer wall of the cleaning rod as is illustrated in FIG. 1 at 102. Open channels as in FIG. 3 may be less costly to manufacture as the result of not having the covering device 110 of FIG. 2 or the additional material of FIG. 1 but the open nature of the channels illustrated may result in the collection of dirt and debris from the barrel cleaning operation.

Figure 4A:
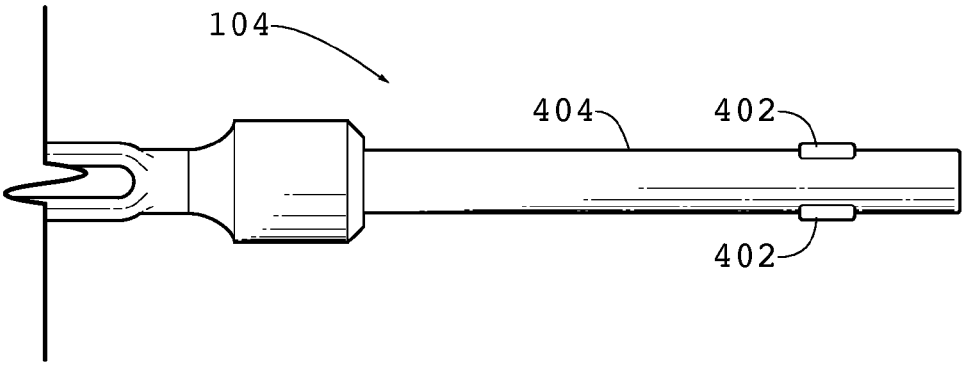
FIG. 4*a* is a side view of a cleaning device interface showing a portion of an embodiment of the invention.
Figure 4B:
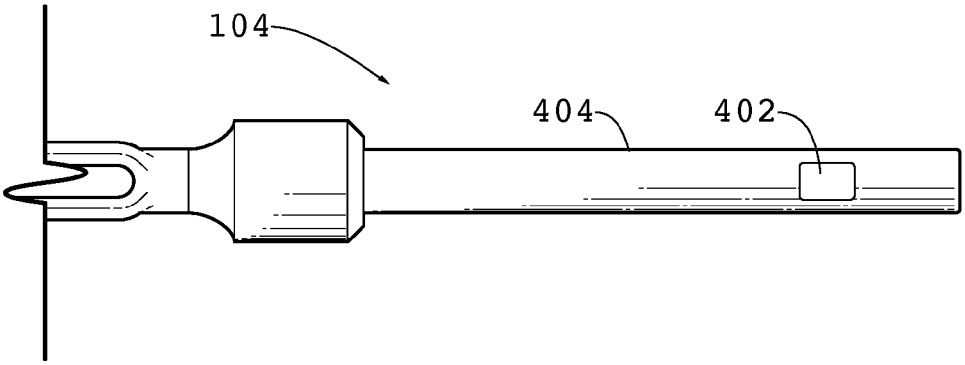
FIG. 4*b* is another side view of a cleaning device interface showing a portion of an embodiment of the invention.

FIGS. 4*a* and 4*b* illustrate alternate side views of an embodiment of the cleaning device interface 104 portion of the invention. As is illustrated, one or more protrusions 402 may be formed in an elongated portion 404 of the device interface. Such protrusions may be guided through a first channel 106 and upon reaching a second channel 107, rotated in a twisting motion about a central axis of the cleaning rod 108 to engage the second channel. Such an engagement is illustrated in FIG. 3 at 304. As will be noted, a slight downward section 306 may be formed at or near the end of the second channel 107. Such a downward section may serve to retain the protrusion 402 portion of the cleaning device interface 104.

In an embodiment of the invention, an elongated portion 404 extends from one end of the cleaning device interface 104. This elongated portion 404 may be sized such that it fits closely inside a recess formed in an end of a cleaning rod or cable. The one or more protrusions 402 may be formed into shapes such as, but not limited to, circles, ovals, diamonds, squares, or rectangular shapes. A rectangular shape is illustrated in FIGS. 4*a* and 4*b*. These protrusions 402 may be aligned with vertical channels 106 formed in an end of a cleaning rod 108 when the cleaning device interface 104 is assembled onto the cleaning rod.

Figure 5A:
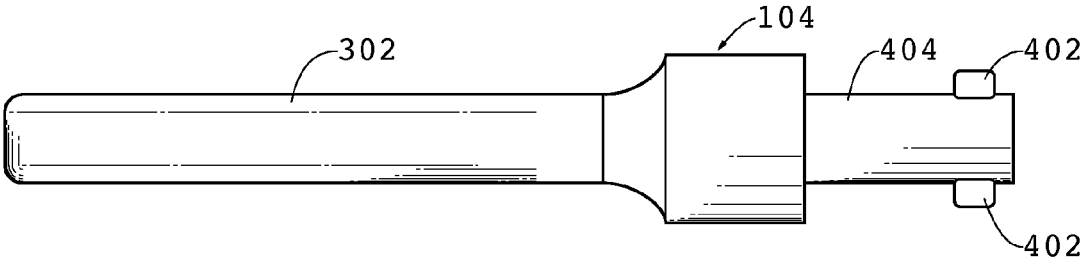
FIG. 5*a* is a side view of an alternate embodiment of a cleaning device interface comprising an integral cleaning device.
Figure 5B:
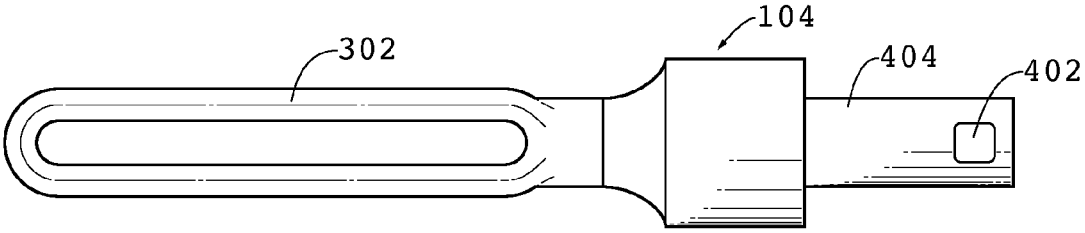
FIG. 5*b* is another side view of an alternate embodiment of a cleaning device interface comprising an integral cleaning device.

A plurality of different cleaning devices may be formed into or otherwise connected to cleaning device interface 104 for attachment to a barrel cleaning rod or cable and as may be noted, cleaning attachment 204 illustrated in FIG. 2 differs from the cleaning attachment 302 shown in FIG. 3 and in FIGS. 5*a* and 5*b*. FIGS. 5*a* and 5*b* illustrate an alternate embodiment of the invention in which a cleaning device 302 is affixed to the cleaning device interface 104. Such cleaning devices may be affixed by methods such as, but not limited to, glue, integral molding, a threaded connection, and crimping. The cleaning device shown is exemplary and it is not intended to represent the only such device that may be used in embodiments of the invention. Many other types of cleaning devices may be used, examples of which may include, but are not limited to, cleaning cloth loops (shown), brushes, scrapers, and swabs. Additional embodiments of the invention may comprise cleaning device interfaces that comprise a threaded opening to allow for the attachment of threaded cleaning devices such that the convenience afforded the to a user of the invention may be extended to other types of cleaning devices.

FIG. 3 is an illustration of an embodiment of the invention in which a cleaning device interface 104 is fully installed in an end of a cleaning rod 108. As is illustrated, a protrusion 402 on the elongated section 404 of the cleaning device interface 104 is shown captured in a downward section 306 of a second channel 107 formed in the end of the cleaning rod 108. To fully install the cleaning device interface 104 in the exemplary embodiment shown, a user may insert the elongated section 404 into a recess formed in a cleaning rod 108 while aligning at least one protrusion 402 with a first channel 106 and pressing the cleaning attachment shaft into the recess formed in the end of the cleaning rod 108. As the user continues to press the elongated shaft into the recess, a protrusion 404 may reach the end of the first channel 106. To secure the cleaning device interface, the user may then twist the cleaning device interface 104 in relation to the cleaning rod 108. In so doing, the protrusion 402 may enter the second channel 107. As the user continues to twist, the protrusion may reach the end of the second channel and enter downward section 306 of the second channel. This downward section 306 serves to capture and retain the protrusion, removably securing the cleaning device interface 104 to the cleaning rod 108. Certain embodiments of the invention may have more than one first and second channels and corresponding protrusions.

Figure 6:
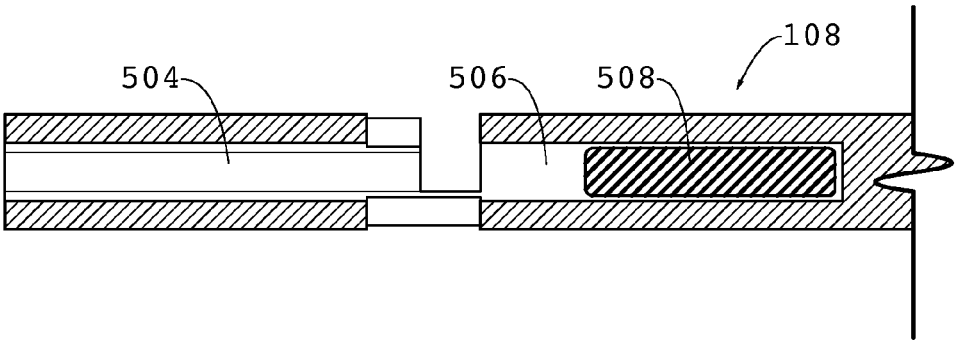
FIG. 6 is an enlarged side view showing the internal structure of a portion of an embodiment of the invention.

Embodiments of the invention may rely on the elasticity of the material of at least one of the cleaning rod 108, the protrusion 402, or the elongated shaft 404 to cause the protrusion to engage with the downward section 306 of the second channel 107 in order to resist movement of the protrusion away from the downward section of the second channel 107. Other embodiments of the invention may utilize a compressible material located in a secondary recess formed at the end of the cleaning rod 108. Referring to FIG. 6, which shows an end of a cleaning rod 108 illustrating the recess 504 into which the elongated shaft 404 (not shown) of a cleaning device interface 104 may be inserted according to the previous discussion herein. Illustrated at 506 is a secondary recess which may contain a compressible material 508. Examples of such a material may be, but are not limited to, one or more of the following: a metal or plastic spring; a piece of rubber; or a piece of silicone material. Such a compressible material 508 may serve resist the entry of the elongated shaft 404 into the secondary recess 504, resulting in a force pushing the protrusion 402 into downward section 306 of the second channel 107 of the cleaning rod. Such an embodiment may be used where the material used to form the cleaning rod 108, the protrusion 402, or the elongated shaft 404 is not sufficiently elastic to engage the protrusion with the downward section of the second channel 107 in a manner that prevents the protrusion from unintentionally leaving the downward section of the second channel, resulting in the cleaning device interface becoming disengaged with the cleaning rod.

Even though the embodiments illustrated thus far comprise a single protrusion, other embodiments of the invention may comprise a plurality of such protrusions and corresponding horizontal and vertical channels.

To conduct a gun barrel cleaning operation, a user may perform the described twisting motion to attach and remove cleaning attachments without having to repeatedly twist to attach and detach cleaning attachments as is the case when using known threaded attachment methods. In addition to attachment of cleaning attachments, the invention may be applied to connect additional sections of barrel cleaning rods to accommodate longer barrels.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A system for cleaning debris from a tubular barrel assembly comprised of:

a cleaning rod device wherein a recess has been formed in at least one end of said rod for insertion of an interface device;

at least one first channel formed in said recess and oriented to be substantially parallel with an axial dimension of the cleaning rod, where such first channel(s) are substantially aligned with the axis of said cleaning rod;

at least one second channel formed in said recess, where such second channel(s) are aligned at an angle to said first channel(s), said second channel(s) comprising at least one channel portion that is enlarged, with respect to the remaining channel portions, in a direction towards the end of said cleaning rod which comprises said opening of said recess in said cleaning rod; and a barrel cleaning tool interface device which is comprised of an elongated shaft, where such shaft comprises at least one protrusion extending radially from a central axis of such shaft, where such protrusion(s) are insertable from a first end portion of the cleaning rod into said first channel(s) to allow such shaft to be inserted into said recess.

2. The system of claim 1, where said protrusion(s) are insertable into said second channel(s) to allow said interface device to partially rotate axially in relation to said cleaning rod.

3. The system of claim 1, where said recess extends axially such that said elongated shaft does not fully occupy said recess when said elongated shaft is fully inserted into said recess.

4. The system of claim 3, where an elastomeric material is deposited in such portion of said recess not occupied.

5. The system of claim 3, where a spring material is deposited in such portion of said recess not occupied.

6. The system of claim 1, wherein said interface device additionally comprises a barrel cleaning device.

7. The system of claim 1, wherein said cleaning rod device is flexible.

8. The system of claim 1, wherein said interface device additionally comprises a cleaning rod.

9. A cleaning rod device wherein:

a recess has been formed in at least one end of said rod to receive an elongated shaft of an interface device;

said recess comprising at least one first channel formed in said recess, said first channel configured with an opening to allow insertion into said channel, at a first end of said rod, of a protrusion formed in an elongated shaft of the interface device where such first channel(s) are substantially aligned with the axis of said cleaning rod;

said recess further comprising at least one second channel formed in said recess, where such second channel(s) are aligned at an angle to said first channel(s), said second channel(s) comprises at least one channel portion that is enlarged, with respect to the remaining channel portions, in a direction towards the end of said cleaning rod in which is comprised said opening of said recess in said cleaning rod.

10. The cleaning rod of claim 9, where at least one protrusion formed in an elongated shaft of an interface device is insertable into said second channel(s) to allow such interface device to partially rotate axially in relation to said cleaning rod.

11. The cleaning rod of claim 9, where said recess extends axially such that said elongated shaft does not fully occupy said recess when said elongated shaft is fully inserted into said recess.

12. The cleaning rod of claim 11, where an elastomeric material is deposited in such portion of said recess not occupied.

13. The cleaning rod of claim 11, where a spring material is deposited in such portion of said recess not occupied.

14. The cleaning rod of claim 9, wherein said cleaning rod device is flexible.

15. A cleaning rod device wherein:

a recess has been formed in at least one end of said rod to receive an elongated shaft of an interface device;

said recess comprising at least one first channel formed in said recess, where such first channel(s) are substantially aligned with the axis of said cleaning rod;

said recess further comprising at least one second channel formed in said recess, where such second channel(s) are aligned at an angle to said first channel(s);

said recess extends axially such that said elongated shaft does not fully occupy said recess when said elongated shaft is fully inserted into said recess; and a spring material is deposited in such portion of said recess not occupied.

16. The cleaning rod of claim 15, where said spring material is an elastomeric material is deposited in such portion of said recess not occupied.

* * * * *